US007089923B2

(12) United States Patent
Johnson

(10) Patent No.: US 7,089,923 B2
(45) Date of Patent: Aug. 15, 2006

(54) UNIVERSAL COMPOUND BOW PRESS

(75) Inventor: Kenneth Johnson, 8301 - 11th Ave. S, Bloomington, MN (US) 55420

(73) Assignee: Kenneth Johnson, Bloomington, MN (US)

( * ) Notice: Subject to any disclaimer, the term of this patent is extended or adjusted under 35 U.S.C. 154(b) by 0 days.

(21) Appl. No.: 10/086,224

(22) Filed: Feb. 23, 2002

(65) Prior Publication Data

US 2004/0194770 A1 Oct. 7, 2004

(51) Int. Cl.
*F41B 5/00* (2006.01)

(52) U.S. Cl. ..... 124/1; 124/86

(58) Field of Classification Search ..... 124/1, 124/80, 86

See application file for complete search history.

(56) References Cited

U.S. PATENT DOCUMENTS

| | | | | | |
|---|---|---|---|---|---|
| 3,055,655 | A | * | 9/1962 | Chelf | 29/235 |
| 4,599,987 | A | * | 7/1986 | Rezmer | 124/23.1 |
| 5,022,377 | A | * | 6/1991 | Stevens | 124/23.1 |
| 5,125,389 | A | * | 6/1992 | Paff | 124/86 |
| 5,222,473 | A | * | 6/1993 | Lint | 124/86 |
| 5,370,103 | A | * | 12/1994 | Desselle | 124/86 |
| 5,425,350 | A | * | 6/1995 | Egusquiza | 124/86 |
| 5,433,186 | A | * | 7/1995 | Corwin | 124/86 |
| 5,746,192 | A | * | 5/1998 | Gissel | 124/1 |
| 5,957,120 | A | * | 9/1999 | Wiseby et al. | 124/86 |

* cited by examiner

*Primary Examiner*—John A. Ricci

(57) ABSTRACT

This invention is a inexpensive light weight portable compound bow press that is safer and easier to use. A bow press with a greater mechanical advantage, to be used in the complete maintenance of high powered compound bows having either two piece limbs or one piece limbs. This invention consists of two extending members. Each extending member connects to the outer end of one of the bows limbs, and extend over and away from the outer ends of the bow's first and second limbs. The first end of a liner adjusting apparatus is connected to the first extending member at a central position near the outer edge of the first extending member. The second end of the adjusting apparatus is connected to the second extending member at a central position near the outer edge of the second extending member. This arrangement positions the adjusting apparatus outside and away from the compound bow, allowing for safer and easier use. The adjusting apparatus allows the archer to exert an inward force on the extending members. The extending members apply force to the outer ends of the bow's limbs, thus flexing the entire length of the limb and applying a reduced stress on the bow's riser and limbs. The mechanical advantage provided by the extending members reduces the stress on the adjusting apparatus allowing for the maintenance of high powered bows with lighter weight components. The bow's limbs are flexed inward and locked against their felix action. This way, the bow's string and cables relax and can be removed. The adjusting apparatus can then be reversed until all flex in the bow's limbs is eliminated. The bow press can be removed and the bow can then be disassembled. Assembly of the bow requires reversing this procedure.

2 Claims, 6 Drawing Sheets

UNIVERSAL COMPOUND BOW PRESS

BACKGROUND OF THE INVENTION

This invention relates generally to the sport of archery, and more specifically to compound bows. The invention is a portable bow press which allows an archer to relieve the tension on the limbs, string and cables of high powered compound bow having either two-piece limbs or one-piece limbs with greater easy and safety for the archer and less risk of damage to the bow's limbs and riser.

PRIOR ART

Paff, U.S. Pat. No. 5,125,389 discloses a tensioning apparatus for tensioning of the limbs of a compound bow with one-piece limbs. Thus enabling the removal and replacement of the compound bow's string and cables. This apparatus uses the same or similar means of connecting to the bow's limbs as Rezmer, U.S. Pat. No. 4,599,987 and Egusquiza, U.S. Pat. No. 5,425,350, and Gissel, U.S. Pat. No. 5,746,192. They use a "T" shaped end, a loop and pin arrangement, or a cord or cable arrangement, that is attached inside the cam grove, at the closed end of single piece bow limb's. Rezmer's FIG. 3. shows how the above limb attachments uses the closed end of the cam grove to keep the attachments from sliding toward the riser. Because this type of attachment uses the closed end of the cam grove to prevent the attachment from sliding toward the riser of the bow, none of the devices listed above can be used to repair compound bows having two-piece limbs. FIG. 5 Prior Art shows a two-piece bow limb. These devices are limited to compound bows with one-piece limbs. FIG. 6 Prior Art shows a one-piece bow limb. Two-piece limbs having cam groves that extend to the riser, require a tensioning device with a means of attachment different from those described above.

All the devices listed above except Egusquiza's device are described as being limited to assisting in replaces strings and cables. They are not capable of assisting in the complete assembly, and disassembly of a compound bow. This is because their adjustment device is limited in travel.

Gissel's device uses the compound bow's string to tension the limbs. Gissel's device is more limited because it is unable to be used for the maintenance of a compound bow with a broken string.

The limb of a compound bow is made tapered. Being thicker at the riser and thinner at the outer end. Therefore, the greatest flex is at the outer end of the limb. All of the devices listed above apply force a distance away from the outer end of the bow limb. They apply force inside the bow, between the bow's cam and its riser. See FIG. 1 of Paff's US patent. Here the limb is thicker and less flexible. None take advantage of the flex at the end of the bow's limb. None of the above devices flex the entire length of the bow's limb.

Because these devices apply pressure to the thicker section of the bow's limb they must apply additional force to flex the limbs inward the distance needed to remove the bow's string or cables. This adds to the risk of damaging the bow's riser and the limbs, especially when maintaining high powered bows. These devices also require stronger and heavier component to apply the additional force needed the flex the bow's limbs at this inside position. Thus making these devices over weight and more costly.

Paff, U.S. Pat. No. 5,125,389 and Rezmer, U.S. Pat. No. 4,599,987 and Egusquiza, U.S. Pat. No. 5,425,350, and Gissel, U.S. Pat. No. 5,746,192, require that the archer attach the device between the bow's string and the bow's riser. Paff's FIG. 1 show this attachment. This is a confined area, making it difficult to operate the adjusting device. Such positioning also increases the risk of the archer being injured while using these devices. If a string or cable would brake while the archer's is operating these devices, the archer could be injured.

Steven, U.S. Pat. No. 5,022,377 titled Portable Bow Press is the largest of the portable devices listed. Its design uses an adjusting device that extends to tension the limbs. This type of adjusting device must be made many times stronger then a pulling or contracting adjusting device. Compound bows are sold in lengths up to forty-eight inches, and have draw weights of up to one hundred and twenty pounds. For Steven's device to be useful on these high powered compound bows it would have to be greatly reinforced. Such reinforcement would make it heavy and expensive.

Steven's device requires more pressure to force the limbs of a compound bow inward then the devices discussed earlier. The point at which the force is applied to the bow limbs is even closer to the riser where the bow limbs are thicker. Steven's device, like all the devices mentioned earlier, is also unable to flex the entire length of the bow's limbs.

Steven's device also applies all the force of its adjusting device to the center of the bow's riser. By applying pressure to the bow's riser at the its center, combined with the position at which the force is applied to the limbs, there is a high probability of damaging the riser and the limbs. This risk is increased when maintaining high powered bows.

There are two other devices that need to be added to this prior art. Neither of these devices were found during the patent search.

The Bowmaster Portable Bow Press Quad Bracket is shown in FIG. 7 Prior Art taken from Archery Center International Plus's 20001 catalog, page 349. This device is an adapter for Rezmer, U.S. Pat. No. 4,599,987 and Egusquiza, U.S. Pat. No. 5,425,350, and Gissel, U.S. Pat. No. 5,746,192 devices. It adapts the listed devices to two-piece bow limbs. As the picture shows it attaches to the end of the split limb and hanging next to or on top of the bow string. As described by Bow Master, in the case of bows with large cams, the bracket is hung between the string and the cables. Either position would cause a great amount of difficulty for the archer since there is no space to operate the adjusting device. It also risks damaging the string and cables by rubbing against them.

These brackets have curved upper ends which can not mate with limb having square or flared ends. This limits the brackets usefulness.

The Cardoza Handi-bow Press is shown in FIG. 8 Prior Art taken from Archery Center International Plus's 20001 catalog. page 349. This bow press is attached to the bow in the same area as the devices of Rezmer, U.S. Pat. No. 4,599,987 and Egusquiza, U.S. Pat. No. 5,425,350, and Gissel, U.S. Pat. No. 5,746,192. Therefore it dose not flex the entire bow limb. It also risks over stressing the bow's limbs.

The length of the brackets (b) between where they contact the bow limb and the adjustment device, combined with the mounting of the brackets (b) on the side of the bow, requires the brackets be reinforced. This increases the weight and cost of Cardoza's bow press and makes it unsuitable for pressing high powered bows.

Being positioned on the side of the bow can cause Cardoza's press to apply force off center, twisting the limbs and damaging both the bow's limbs and riser.

There is a need in the archery art for a inexpensive light weight portable compound bow press that allows an archer to disassembly and assembly of high powered compound bows with both two-piece limbs and one-piece limbs with out over-stressing the bows limbs or risking damage to the bow's riser. There is a need for a portable compound bow press that provides easier use and greater safety. There is a need for a compound bow press that applies force to the outer ends of the compound bows limbs, thus flexing the entire length of the bow's limbs. There is a need for a compound bow press that uses the minimum amount of force to flex the bows limbs. There is a need for a compound bow press that can press bows with either two-piece or one-piece limbs without risking damage to the bows string or cables. There is a need for a portable bow press that can press bows with either two-piece limbs or one-piece limbs without the use of special adapters that limit the two-piece limbs to having rounded ends.

OBJECTS AND ADVANTAGES

Several objects and advantages of my invention are;

(a) to provide a portable bow press capable of assisting in the disassembly and assembly of compound bows with either two-piece limbs or single piece limbs.

(b) to provide a portable bow press that flexes the entire length of the bow's limbs.

(c) to provide a portable bow press that is easier to use.

(f) to provide an inexpensive portable bow press.

(g) to provide a light weight portable bow press.

(h) to provide a portable bow press that provides a greater safety for the archer.

(i) to provide a bow press that reduces the stress on the compound bow's riser and limbs.

(j) to provide a portable bow press that is capable of assisting in the disassembly, assembly of high powered compound bows.

Further objects and advantages will become apparent from a consideration of the ensuing description and drawings.

NUMERICAL REFERENCE TO DRAWINGS

2 Compound bow with two-piece limbs

4 Portable bow press of this invention

6 First two-piece bow limb

8 Second two-piece bow limb

10 Riser

12 First extending member

14 Second extending member

16 Adjusting device, which includes necessary linkage

20 First removable engagement device

21 Second removable engagement device

22 Work space between adjusting device, and bow string and cables

24 Portion of first extending member that provides mechanical advantage.

25 Portion of second extending member that provides mechanical advantage.

26 Outer end of first two-piece bow limb

27 Outer end of second two-piece bow limb

28 Bow string and cables

30 Central position for adjustable connection of first extending member to first end of adjusting device

32 Central position for adjustable connection of second extending member and second end of adjusting device

34 Aligning device to aid in aligning first extending member with outer end of first two-piece bow limb

36 Aligning device to aid in aligning second extending member with outer end of second two-piece bow limb

DETAILED DESCRIPTION OF THE INVENTION

Figure 1:
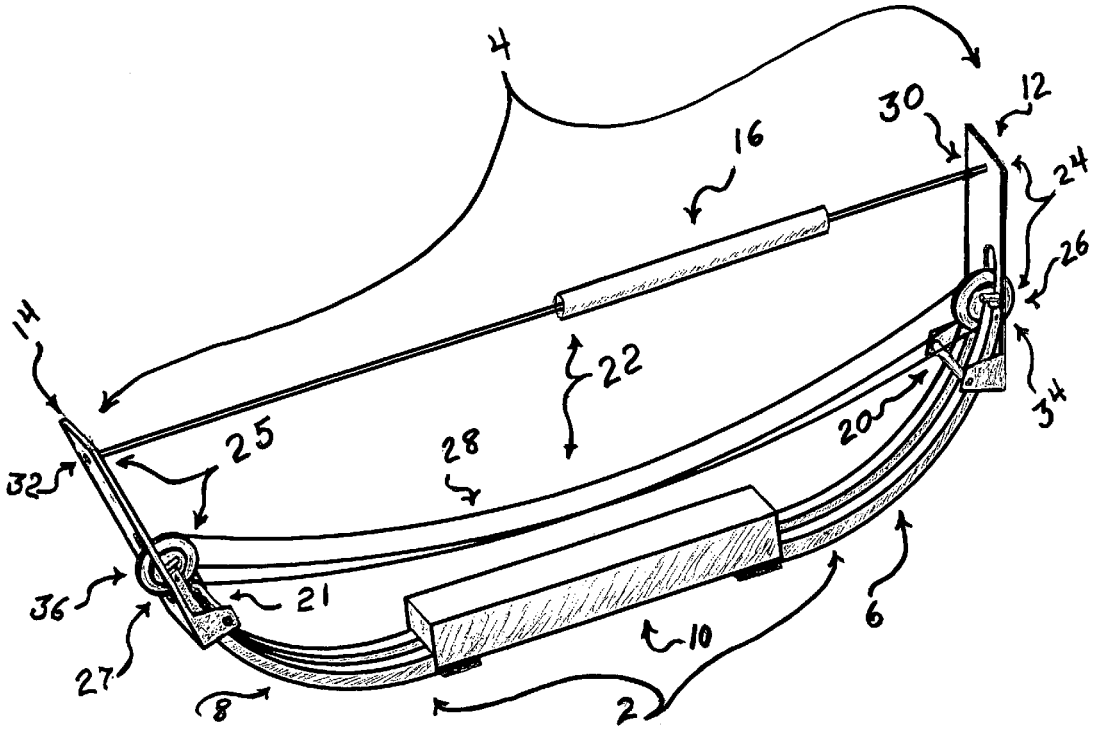
FIG. 1 is an isometric drawing of the device of this invention mounted on a bow with two piece limbs.

FIG. 1 shows an isometric view of a portable bow press of this invention 4 attached to a compound bow having two-piece limbs 2. Compound bow 2 having first two-piece limb 6 and the second two-piece limb 8, and riser 10. The compound bow press 4 consisting of first extending member 12, second extending member 14, adjusting device 16, first removable engagement device 20, second removable engagement device 21, first aligning device 34 and second aligning device 36. Extending members are made of a ridged material. Extending member 12 is engaged with the end portion of bow limb 6, using removable engagement device 20 and aligning device 34. Extending member 14 is engaged with the end portion of bow limb 8, using removable engagement device 21 and aligning device 36. Extending member 12 extends beyond the outer end 26 of limb 6. Extending member 14 extends beyond the outer end 27 of limb 8. The engagement of the extending members 12 and 14 are such that, the end portion of first limb 6 cooperates with the first extending member 12 and first removable engagement device 20. The end portion of second limb 8, cooperates with the second extending member 14 and removable engagement device 21. Adjusting device 16 is adjustably connected to the first extending member 12 at a central position 30, near the outer edge of the extending member 12. The second end of adjusting device 16 is adjustably connected at a central position 32 near the outer edge of the second extending member 14. Thus providing a working space 22 between bow string and cables 28, and the adjustable device 16. Adjusting device 16 is positioned on the outside of the compound bow 2. Working space 22 and the positioning of adjusting device 16 on the outside of compound bow 2, provides a means for easy and safe operation of the adjusting device 16.

Figure 2:
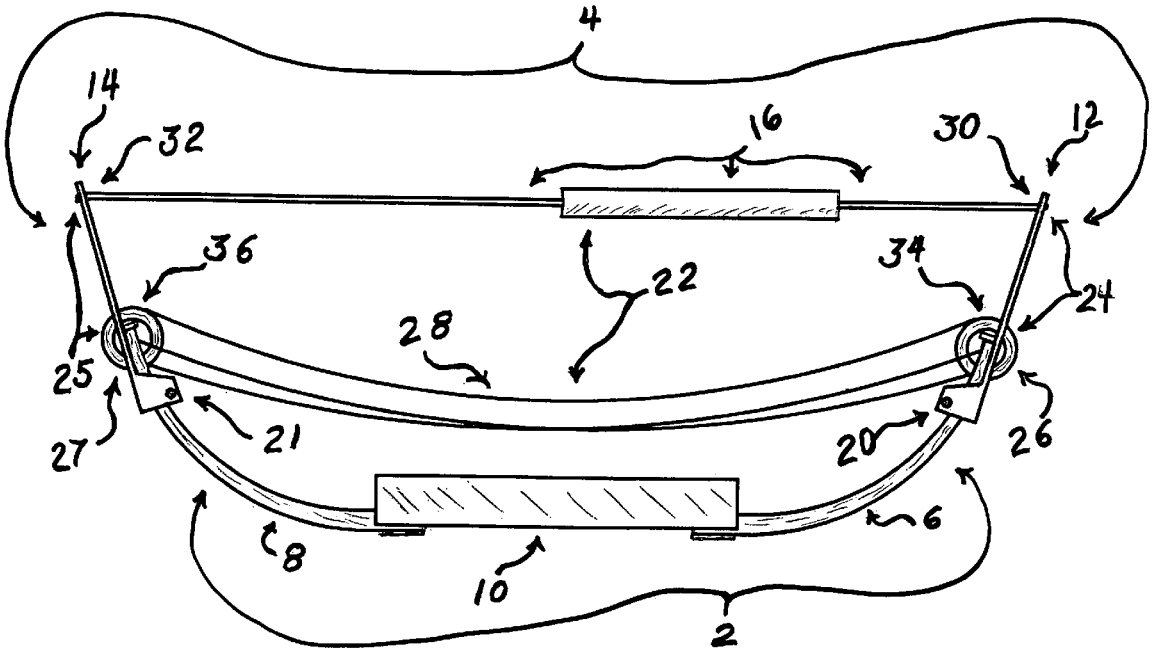
FIG. 2 is a side view of the device of this invention.

FIG. 2. shows the side view of FIG. 1. When the adjusting device 16 is shortened, extending members 12 and 14 are forced inward toward each other. The removable engagement device 20 engages bow limb 6 holding extending member 12 in place. The removable engagement devices 21 engages bow limb 8 holding extending member 14 in place. The extending members 14 pivots on outer end 27, and applies an inward force at outer end 27. The force at outer end 27 causes the limb 8 to flex inward over its entire length.

The extending members 12 pivots on outer end 26, and applies an inward force at outer end 26. The force at outer end 26 causes limb 6 to flex inward over its entire length. The stress on the limbs 6 and 8 is reduced to a minimum. No part of the bow press of this invention 4 is in contact with the riser 10, thus preventing damage to riser 10. By flexing the entire length of the limbs 6 and 8, less force is needed to move bow limbs 6 and 8 inward the distance needed to remove the bow string and cables 28.

Adjusting device 16 being attached at central positions 30 and 32, causes the inward force to be applied equally on both halves of the two-piece limbs 6 and 8. Thus preventing any twisting of the bow's limbs.

The distances 24 and 25 creates a mechanical advantage that reduces the stress on adjusting device 16. The flexing of bow limbs 6 and 8 over their entire length, and the mechanical advantage provided by the distance 24 and 25 allows for the safe use of a light weight adjusting device 16. Thus reducing the weight and cost of this invention. The combination of flexing the bow limbs 6 and 8 over their entire length, and the mechanical advantage provided by the distances 24 and 25 also allows for the pressing of high powered bows with the light weight portable device of this invention.

Space 22 allows for the use of more varied adjusting devices 16. The adjustable device 16 can be any of the common linear adjusting devices such as a toggle bolt; (see Egusquiza's device) a screw, nut; (see Cardoza Handi-bow Press) or ratchet tie down.

A ratchet tie down is an adjusting device that would not require linkage. A toggle or a screw and nut, are an adjusting devices that could require linkage. The linkage may not be adjustable depending on the adjustment length of these devices. The linkage should have a means of varying its length, if the adjustment length of the adjustable device can not accommodate the different lengths of compound bows used by archers.

The removable engagement devices 20 and 21 in FIG. 1 and FIG. 2 are shown as removable pins. A cincture made of a belt or other material is another means of engagement.

Figure 3:
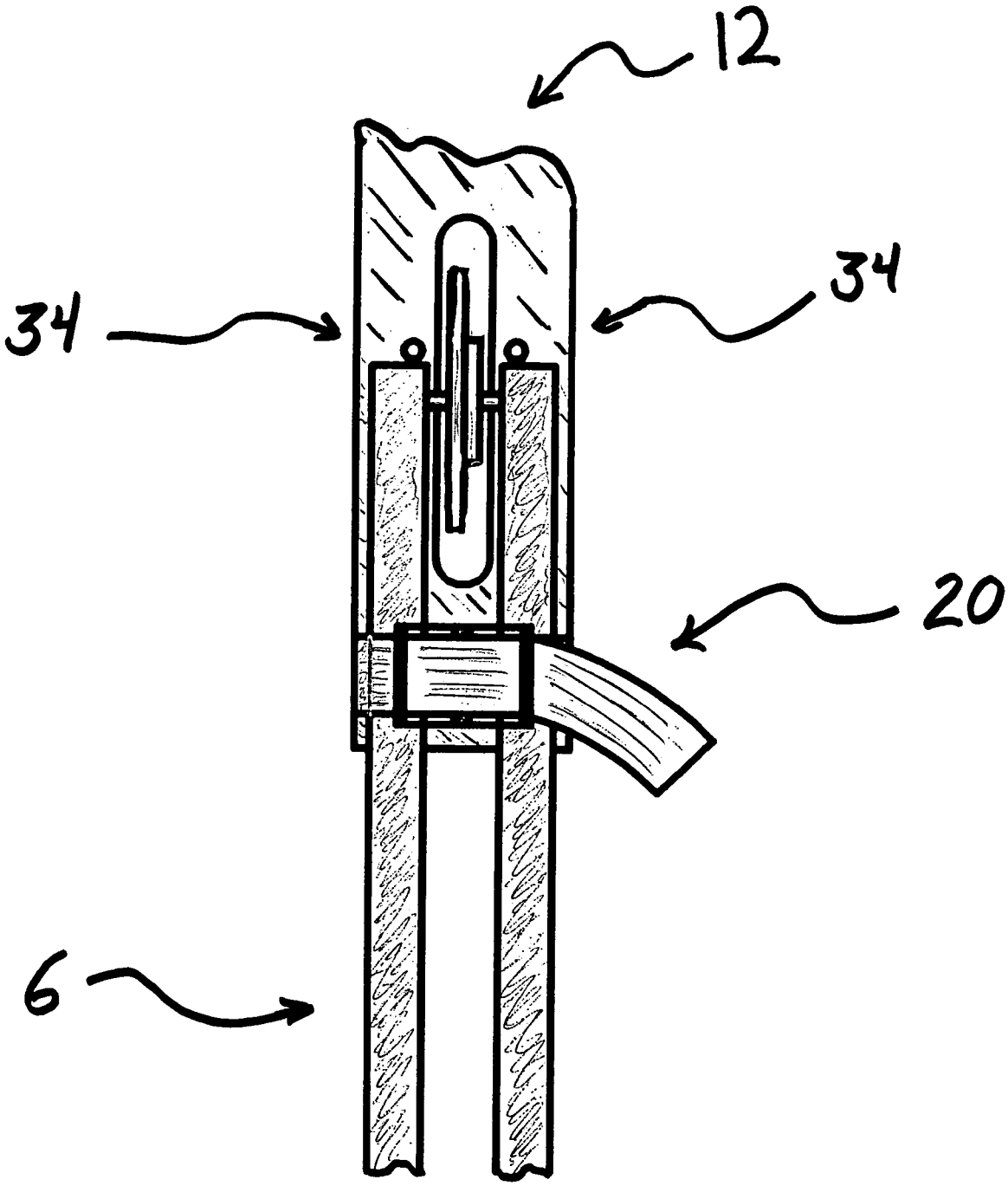
FIG. 3 is a view of a means of engagement of the limb extension and the bow limb.

FIG. 3 shows the inside view of limb 6, and extending member 12. Alignment device 34, and engagement device 20 are shown cooperating with the end portion of limb 6. Engagement device 20 is shown as a cincture belt. This is another means of the extending member engaging the limb.

Figure 4:
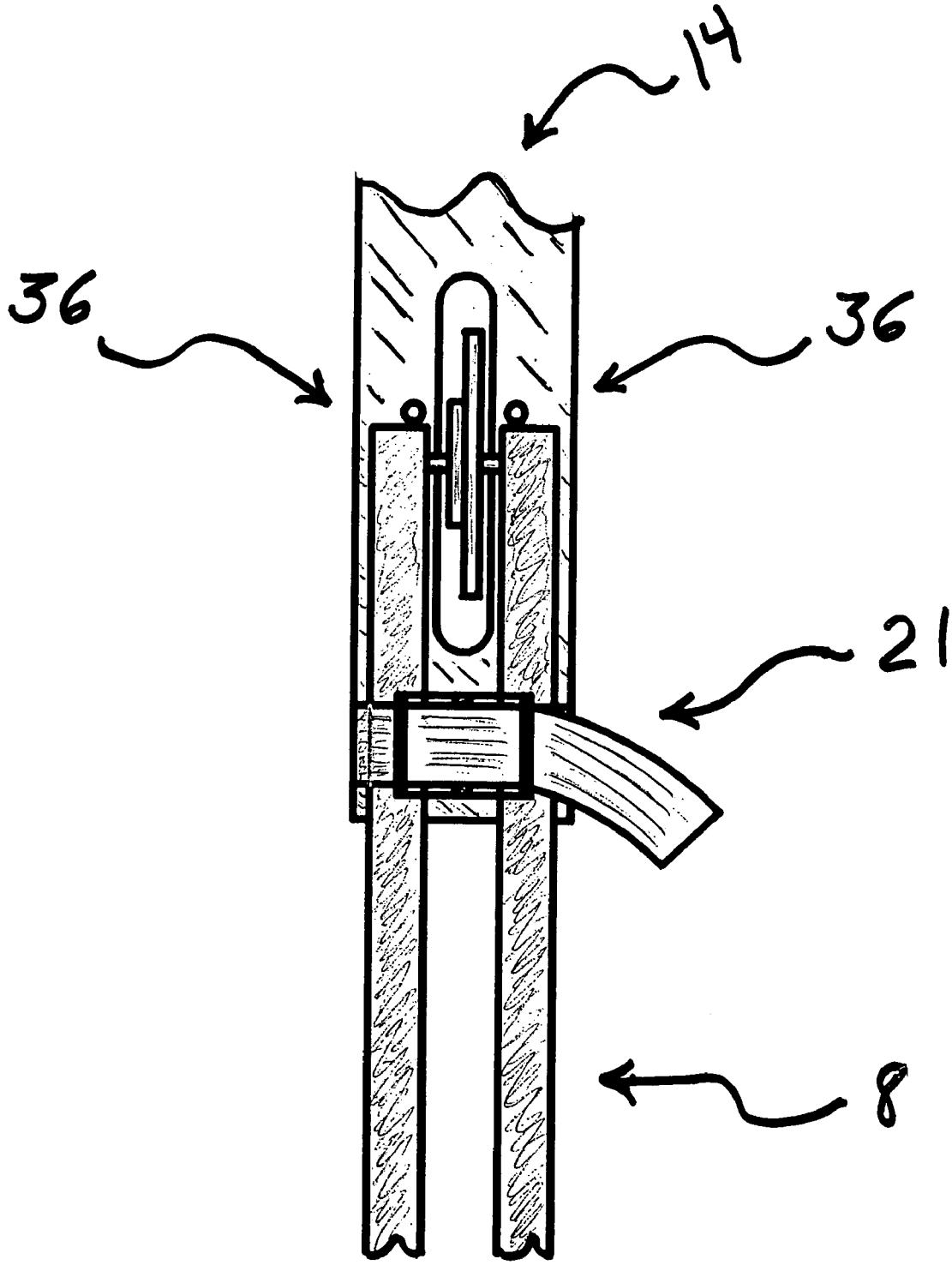
FIG. 4 is a second view of a means of engagement of the limb extension and the bow limb.
Figure 5:
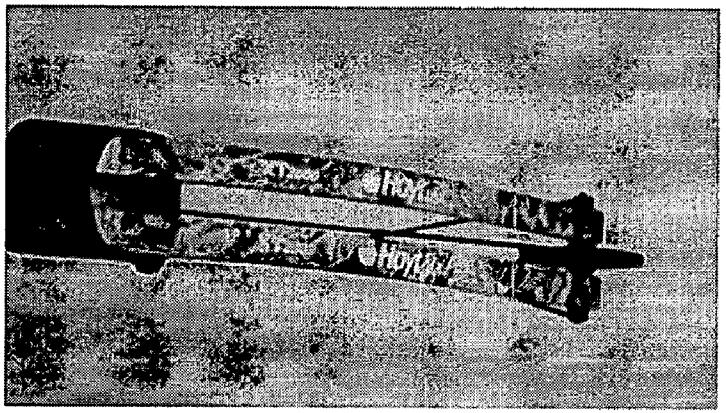
Fig 5 Prior Art
FIG. 5 is a photo of a two piece bow limb described in the prior art.
Figure 6:
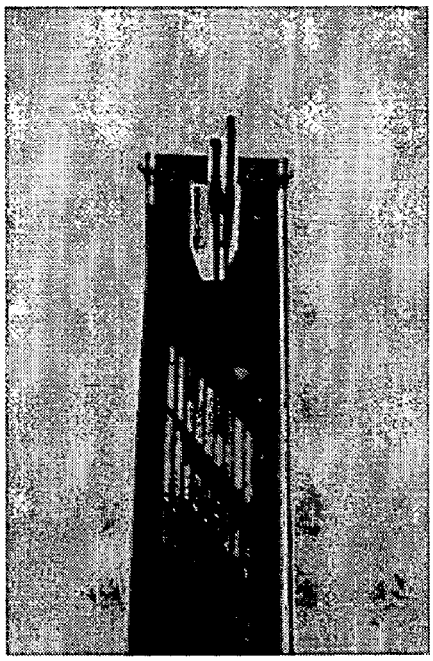
Fig 6 Prior Art
FIG. 6 is a photo of a one piece bow limb described in the prior art.
Figure 7:
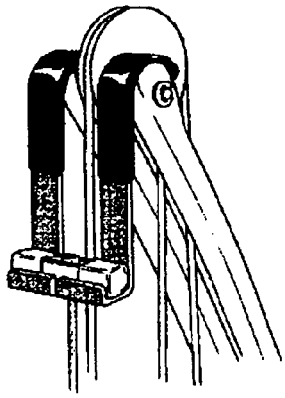
Fig 7 Prior Art
FIG. 7 is a picture of a drawing of the Bowmaster bracket.
Figure 8:
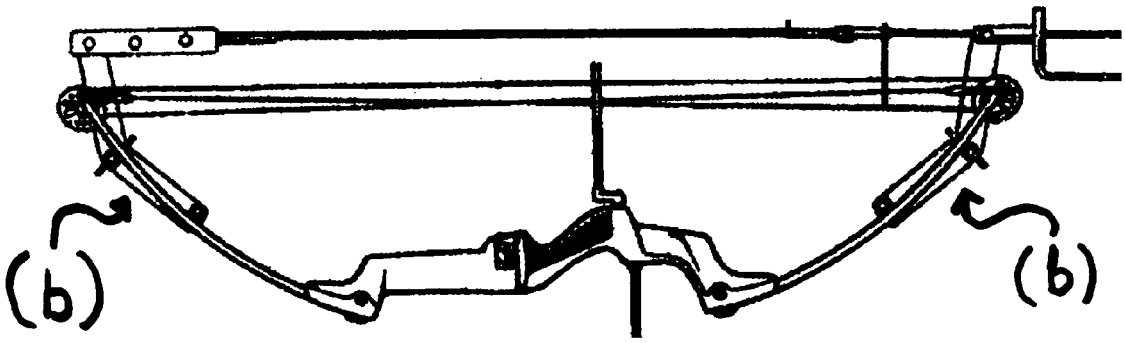
Fig 8 Prior Art
FIG. 8 is a picture of a drawing of Cardoza Handi-Bow Press.

FIG. 4 shows the inside view of limb 8, and extending member 14. Alignment device 36, and engagement device 21 are shown cooperating with the end portion of limb 8. Engagement device 21 is shown again as a cincture belt.

Although the description above contains many specifications, these should not be construed as limiting the scope of the invention, but as merely providing illustrations of some of the present preferred embodiments of the invention.

SUMMERY, RAMIFICATIONS AND SCOPE

The bow press of this invention is unlike any other bow press in its use of extending members to apply force to the ends of the limbs of a compound bow. Force applied in this way will flex the entire length of a compound bow's limbs, reducing the force needed to flex the limbs. Thus reducing the possibility of over stressing the bow's limbs or damaging the bow's riser.

The mechanical advantage the extending members provides, reduces the force on the adjusting device allowing for the use of a lighter weight and less expensive adjusting device.

The mechanical advantage, combined with flexing the bow limbs over their entire length, allows for the maintenance of high powered bows with the light weight portable bow press of this invention.

The extending members of this invention do not need the closed end of the cam grove of a one-piece bow limb to help it engage and cooperate with the outer end of the bow's limb. Therefore they can be used to press compound bows with either two-piece limbs or one-piece limbs.

The extending members also position the adjusting device out side the compound bow for easier and safer operation.

Positioned out side the compound bow, the adjusting device can have greater travel. Enabling it to adjust outward far enough to eliminate all the flex of the compound bow's limbs. Thus, allowing for the complete assembly and disassembly of compound bows.

The inexpensive, light weight, portable bow press of this invention can be easily and safely used to completely disassemble and assemble high powered compound bows with either two-piece limbs or one-piece limbs with out over stressing the bow's limbs, or damaging the bow's riser.

The invention claimed is:

1. A lightweight bow press, for the complete maintenance of compound bows having either one-piece or two-piece bow limbs, a riser connecting first and second said limbs, and a cam located toward an outer end of each of said limbs, comprising:

two limb extending members, of rigid material;

an adjusting device having means to change its length;

a first said limb extending member having first means to engage a first limb of a bow, at a location between a riser of the bow, and a cam mounted toward an outer end of the first limb;

a second said limb extending member having first means to engage a second limb of the bow, at a location between the riser of the bow, and a cam mounted toward an outer end of the second limb;

said first limb extending member having second means to engage the outer end of the first limb;

said second limb extending member having second means to engage the outer end of the second limb;

a first end of said adjusting device engaging said first limb extending member at a point beyond the outer end of the first limb and cam;

a second end of said adjusting device engaging said second limb extending member at a point beyond the outer end of the second limb and cam;

whereby when said adjusting device is shortened, said first limb extending member and said second limb extending member move inward, engaging said limbs, causing said limbs to flex over their entire lengths.

2. The bow press of claim 1, wherein:

said second means of engagement of said first limb extending member with said first limb of said bow, is located beyond the location where the cam is mounted to the limb, toward the outer end of the limb;

said second means of engagement of said second limb extending member with said second limb of said bow, is located beyond the location where the cam is mounted to the limb, toward the outer end of the limb.

* * * * *